US005358763A

United States Patent [19]

Zinbarg

[11] Patent Number: 5,358,763

[45] Date of Patent: Oct. 25, 1994

[54] SPIDER-LIKE DECORATIVE OBJECT

[75] Inventor: Benson Zinbarg, Stamford, Conn.

[73] Assignee: Sun Hill Industries, Inc., Stamford, Conn.

[21] Appl. No.: 16,967

[22] Filed: Feb. 12, 1993

Related U.S. Application Data

[63] Continuation of Ser. No. 664,023, Mar. 4, 1991, Pat. No. 5,211,996.

[51] Int. Cl.[5] ..... B44C 3/06

[52] U.S. Cl. ..... 428/16; 206/457; 206/575; 428/542.2; 434/82; 446/73; 446/268

[58] Field of Search ..... 434/82; 446/73, 268; 428/16, 542.2; 156/61; 206/457, 575

[56] References Cited

U.S. PATENT DOCUMENTS

| | | | |
|---|---|---|---|
| D. 310,023 | 8/1990 | Dembiczak et al. | D9/305 |
| D. 317,254 | 6/1991 | Dembiczak et al. | D9/305 |
| 3,195,265 | 7/1965 | Marquez et al. | D9/311 X |
| 4,174,059 | 11/1979 | Maunder | 446/73 X |
| 4,580,372 | 4/1986 | Osborn | 428/131 X |
| 4,715,840 | 12/1987 | Swift | 446/73 X |
| 5,027,457 | 7/1991 | Sweet | 446/369 X |
| 5,030,162 | 7/1991 | Hall | 428/16 X |
| 5,096,453 | 3/1992 | Van Meter | 446/73 |
| 5,186,675 | 2/1993 | Stoddard | 446/199 |
| 5,211,996 | 5/1993 | Zinbarg | 206/575 X |

FOREIGN PATENT DOCUMENTS

| | | | |
|---|---|---|---|
| 340744 | 7/1904 | France | 446/223 |
| 605558 | 5/1926 | France | 446/223 |

*Primary Examiner*—Henry F. Epstein

*Attorney, Agent, or Firm*—Frishauf, Holtz, Goodman & Woodward

[57] ABSTRACT

A spider-like decorative structure comprising a main bag member having a filling therein, and made of flexible material. A plurality of elongated bag-like tubular members, each having a filling material therein, are arranged adjacent the main bag member at spaced apart locations around the periphery of the main bag member so as to extend from the main bag member. The main bag member simulates the appearance of a body portion of the spider-like decorative object, and the leg members simulate the appearance of legs of the spider-like decorative object. The legs may be connected to the main bag member at the portions which are adjacent the main bag member, and the free ends of the legs are preferably connected to the ground or other support structure for the spider-like decorative object. A support member is provided for raising an articulated intermediate portion of each of the leg members to further simulate the appearance of bent legs of a spider-like decorative object.

12 Claims, 5 Drawing Sheets

SPIDER-LIKE DECORATIVE OBJECT

This is a continuation of application Ser. No. 07/664,023, filed Mar. 4, 1991, now U.S. Pat. No. 5,211,996, issued May 18, 1993.

BACKGROUND OF THE INVENTION

This invention relates to a spider-like decorative object, and more particularly to a decorative object which simulates or otherwise generally represents the appearance of a fanciful conception of a spider, or a fanciful unreal spider or what an observer will understand to be a fanciful conception of the general appearance of a decorative spider-like object. More particularly, the decorative object has a large body member and a plurality of elongated spider-like legs extending therefrom. Throughout the following specification and claims, such a decorative object will be referred to hereinafter as a "spider" or "spider-like" decorative object, or other similar terminology.

Decorative objects are popular for placement on a front lawn of a home, or in any other position in front of a home, such as on a porch, patio, or the like. At certain times of the year, for example in the fall season, many leaves are on the ground and home owners often rake their leaves and dispose of them in relatively large leaf bags. Except for a relatively new type of leaf bag which has recently been sold during the Halloween season to represent or simulate a pumpkin, the known leaf bags are ordinary leaf bags with no particularly significance and with no particular decorative value.

An object of the present invention is to provide a spider-like decorative object for use in connection with a home or the like, and which utilizes a large bag, such as a leaf-type bag, for its basic central structure, and which utilizes a plurality of other leaf-type bags of elongated type to simulate the appearance of legs or the like of a spider or spider-like object. When filled with leaves or crumpled paper and connected together as described hereinbelow, the resulting structure takes the general form and appearance of a fanciful spider or spider-like object.

SUMMARY OF THE INVENTION

According to the present invention, a spider-like decorative object comprises a main bag member having a filling therein, the main bag member being made of flexible material and simulating the appearance of a body portion of the spider-like decorative object; and a plurality of elongated tubular bag-like leg members made of flexible material and having a filling which can be leaves, crumpled paper, other refuse therein, the leg members being arranged adjacent the main bag member, and arranged at spaced apart locations around the periphery of the main bag member to extend therefrom and simulate the appearance of legs of a spider-like decorative object.

In a preferred arrangement, the end portions of the leg members are respectively connected to lower portions of the main bag member at the spaced apart locations, each leg member has an articulated portion at an intermediate portion of the elongated tubular bag-like leg member, and the leg members are raised up, relative to a surface on which the spider-like decorative object is placed, in the vicinity of the articulated portion of the respective leg members.

According to another aspect of the invention, a kit of parts is provided for making or assembling the spider-like decorative object.

DETAILED DESCRIPTION

Figure 1:
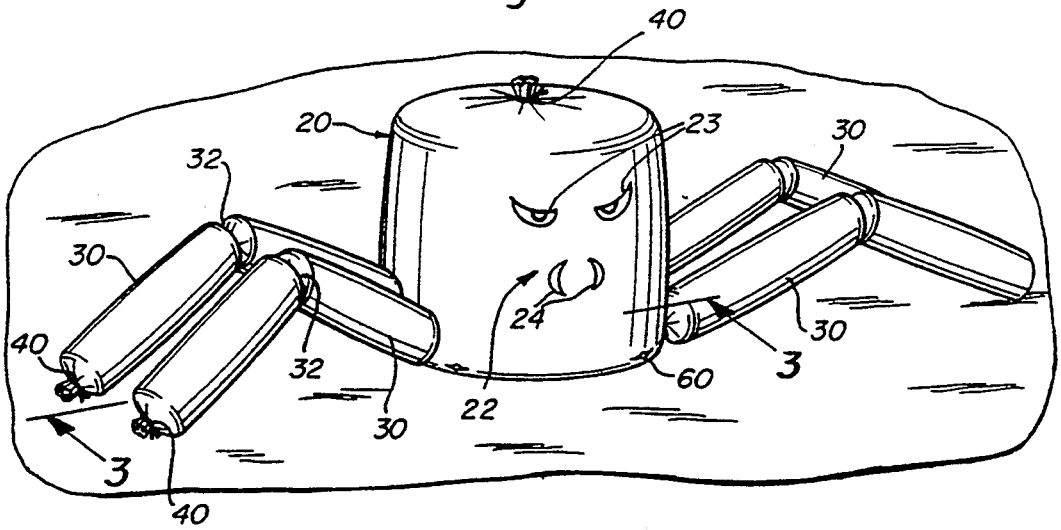
FIG. 1 is perspective view of a spider-like decorative object of the present invention, shown in its assembled state.

Referring to FIG. 1, a spider-like decorative object of the present invention comprises a main bag member 20 which is preferably an enlarged leaf-type bag, which is preferably black in color (or another dark color) and which has facial indicia 22 thereon. Main bag member 20 simulates the appearance of the body of a spider-like decorative object. The facial indicia may comprise, for example, eyes 23 and nose and mouth member 24. Other facial indicia could be used, the showing in FIG. 1 being only by way of example. Also, other indicia, such as facial indicia or other types of indicia, can be provided on the reverse side of the main bag member 20 to enhance the decorative value.

The "legs" of the spider-like member of FIG. 1 comprise elongated bag-like leg members 30. Leg members 30 and main bag member 20 are filled for example with leaves, crumpled newspapers, or other waste or suitable fill material. After filling of the leg members 30, the opposite open ends thereof are tied with flexible twist ties 40. Preferably one end of a tubular leg member is tied or closed off before filling to make filling easier. The leg members 30 are tied at both opposite ends with ties 40 (see FIG. 2 and 3), and is also tied off at the generally central or middle portion thereof, for example as shown at reference numeral 32 in FIG. 1. The resulting member 30, tied at both ends and tied off at a central portion thereof, is effectively articulated around the tied off central portion 32 so as to be bendable at that point in an easy manner. This enables raising of the central portion of each leg member 30 to improve the overall appearance and decorative value of the resulting structure.

Figure 3:
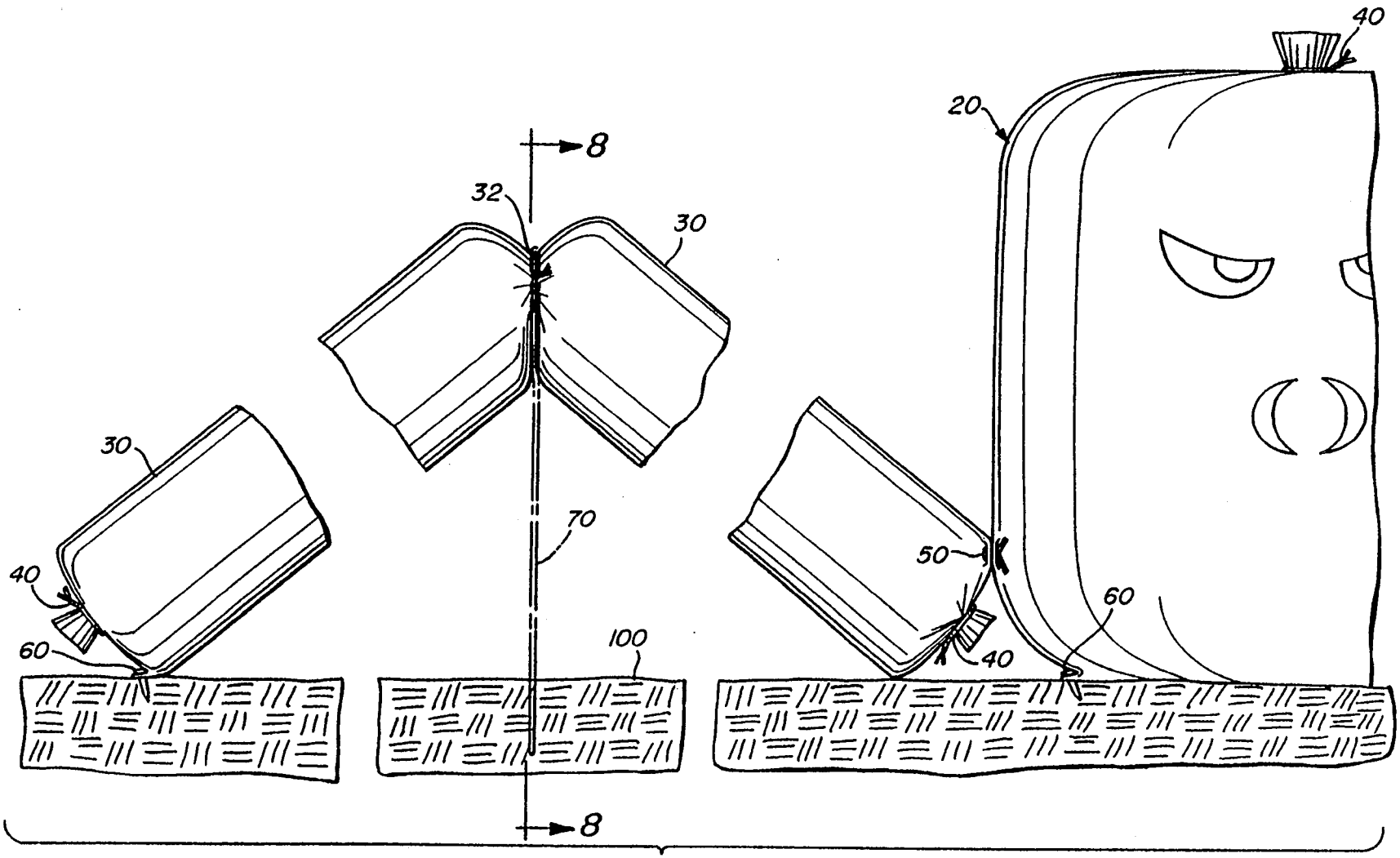
FIG. 3 is an enlarged, partially broken-away view showing a portion of the spider-like decorative object of the present invention, showing how a leg member is assembled to the main body member.
Figure 4:
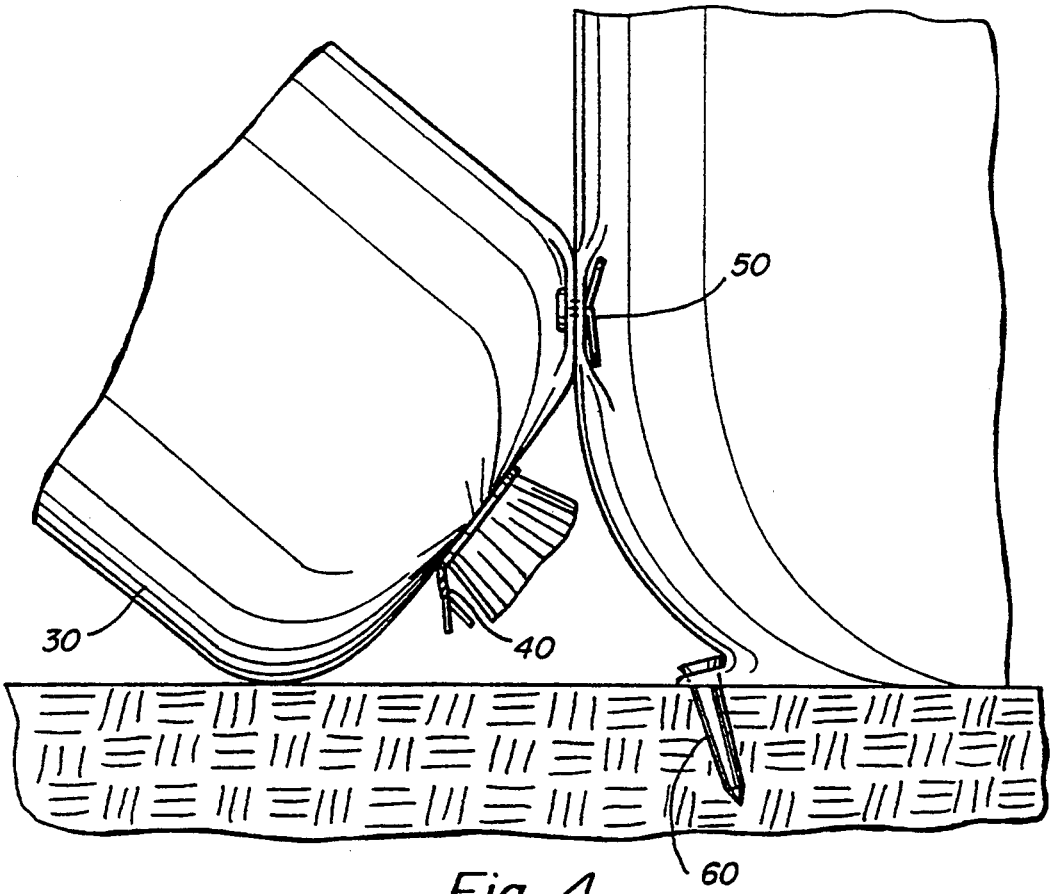
FIG. 4 is a further enlarged view showing details of how a leg member is connected to the main body member.
Figure 8:
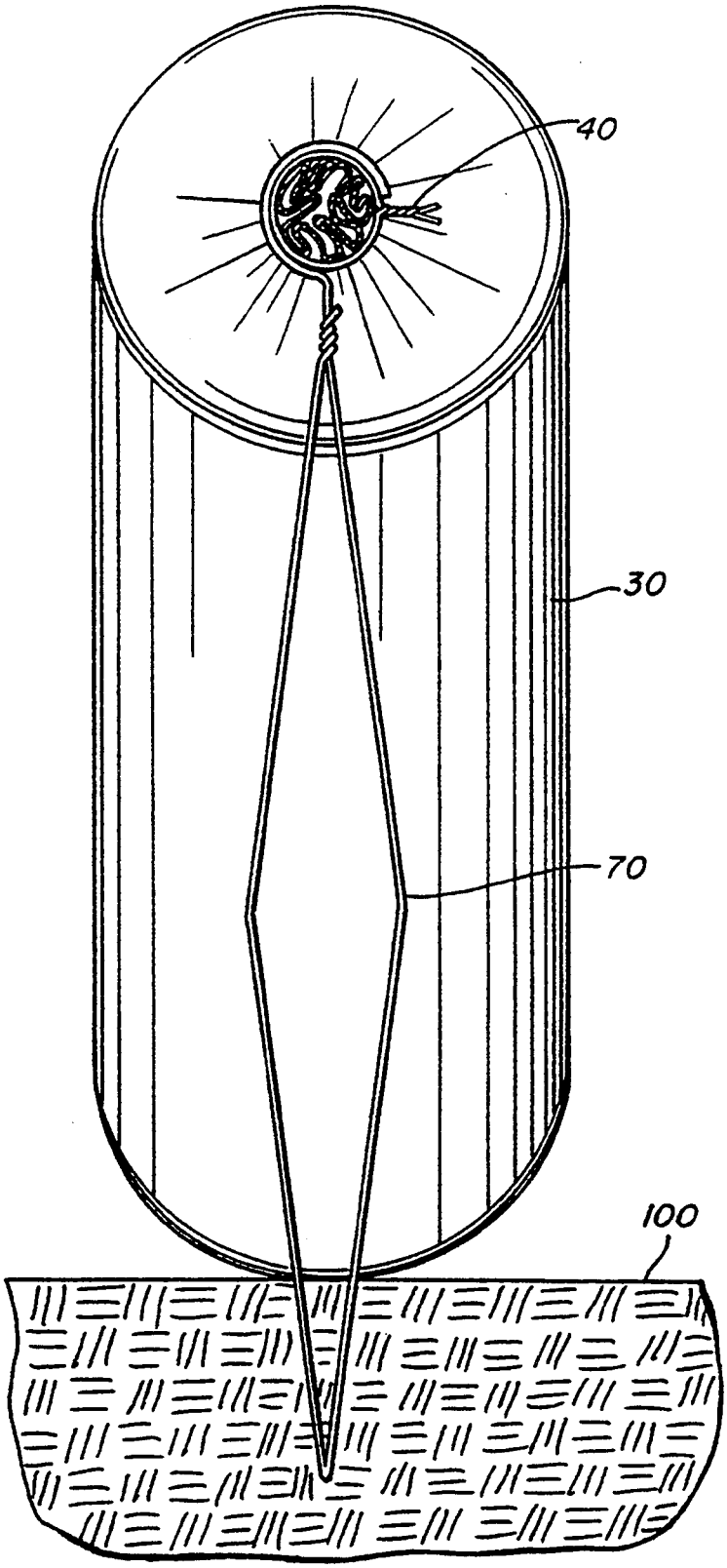
FIG. 8 is a sectional view taken along line 8—8 in FIG. 3.

As shown in FIG. 3, one end of each elongated member 30 is connected to the main bag structure 20 by means of a spread clip 50 or the like (see enlarged view of FIG. 4). Alternatively, the tack arrangement of FIG. 10 could be used. The intermediate portion 32 of each leg member 30 is raised up from the ground by using, for example, a hanger (such as an ordinary clothes hanger) 70 which has its top or hook end connected over the tied off central portion 32 (see FIGS. 3 and 8), and which has another end thereof bent so as to be generally pointed for insertion into the ground 100, as shown in FIG. 8. In the raised-up condition, where the articulated portion is raised, each leg presents a generally inverted V-shape. Piercing the ground 100 with the end of the hanger 70 improves the structural rigidity of the overall construction, and enhances its durability. Instead of a wire hanger 70, other wire members, wooden members, plastic members, or other suitable support members could be used to support the intermediate articulated portion 32 of the spider leg members 30. The remote or distal end of the leg 30 is pegged to the ground 100 by means o f, for example, a peg or tee 60 as shown in FIG. 3 or a stake member of FIG. 9. The peg or tee 60 is pierced through a portion of the plastic bag 30, and is then pressed into the ground, as shown in FIG. 3. The main body member 20 is also connected to the ground in the same manner, by means of pegs or tees 60, such as shown in FIGS. 3 and 4 or by stakes of FIG. 9, which pierce the bag material and are inserted into the ground.

The spider-like decorative object of FIG. 1 comprises a main body 20 and four leg members 30. More or fewer leg members 30 could be provided, as desired, around the main bag 20.

The main body member 20 is preferably formed of a main bag of Z-lock construction, which Z-lock construction is generally known in the art to form a rounded bottom. The bag members 30 preferably comprise extruded tubular bag members which are open at both opposite ends, and which are tied off at both opposite ends by flexible twist ties, as described hereinabove. Also, as mentioned hereinabove, the twist tie is useful for tying off a central or generally central portion of leg member 30 to provide an articulated portion about which bag member 30 can more easily bend to provide a more realistic-looking spider-like decorative object.

Figure 7:
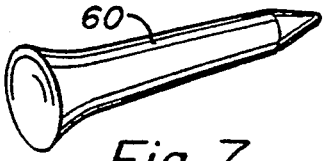
FIG. 7 is a perspective view of a peg or golf tee for use as a stake in the present invention.
Figure 9:
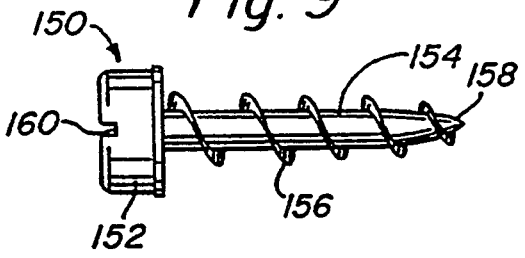
FIG. 9 is a side view of an alternate stake for use in the present invention in place of the peg or tee of FIG. 7.

FIG. 9 illustrates a screw-threaded-type stake member 150 which can replace the peg or tee of FIG. 7 for securing the apparatus to the ground. The member 150 has a head portion 152 and a shaft or shank portion 154 with threads (similar to screw threads 156) thereon. The shank portion 154 is provided with a generally pointed end 158 for ease of insertion into the ground or the like. In use, the user pierces the plastic bag with pointed end 158 and applies pressure on the head 152 so that the pointed end 158 begins to penetrate the ground or the like. Then, the head 152 is either pressed straight into the ground (if it is soft enough) or it is turned by hand, or a coin or the like is inserted into the coin or screw driver slot 160 to turn the stake 150, to "screw" it into the ground or the like. The stake 150 can be molded from plastic material (i.e., polypropylene) by injection molding or may be otherwise formed.

Figure 5:
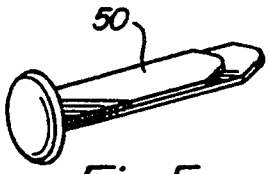
FIG. 5 is a perspective view of a spread clip-type connecting device for use in the present invention.
Figure 6:
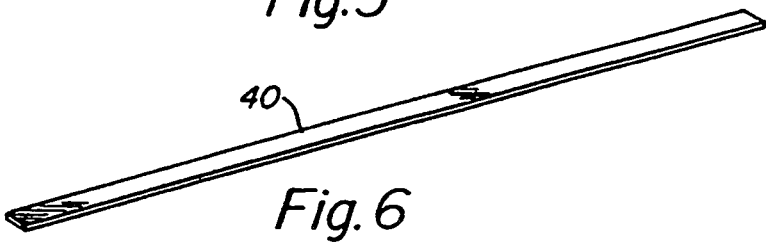
FIG. 6 is a perspective view of a flexible "tie" for use in the present invention.
Figure 10:
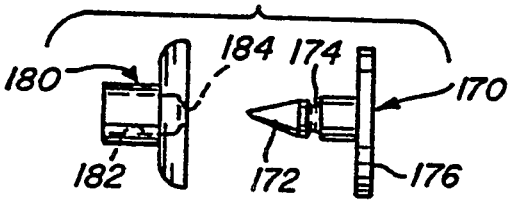
FIG. 10 is a side view of a connector or tack structure mechanism to replace the spread clip of FIG. 5, for use in the present invention.

FIG. 10 shows a tack structure which can replace the spread clip 114 shown in FIG. 5. The tack structure of FIG. 10 comprises a push-tack 170 having a pointed shank member 172 with a recess 174 therein. A receptacle 180 is provided which has an elongated opening 182 therein with a reduced cross-sectional opening portion 184 at the front end thereof. In use, the plastic parts to be tacked together or clipped together are held by the user, the tack member 170 is pushed therethrough beginning with the pointed end 172 by applying pressure to the head end 176, and the receptacle member 180 is placed behind the tack and the pointed end 172 of tack member 170 is pushed into the opening of the receptacle member and the reduced diameter portion 184 "snaps" into the reduced diameter section of shank 172 to "snappingly lock" thereon, and to hold the clipped plastic parts together. The snap action engagement is obtained by virtue of the resiliency of the plastic material from which the tack 170 and receptacle 180 are made, for example polyethylene or polypropylene or other suitable injection moldable plastic material.

Various other devices can be used in place of the stake of FIG. 9 and the tack structure of FIG. 10, as desired.

In the illustrated embodiment, typical (but not limiting) dimensions are:

1. Length of main bag member 20: 48" Preferable (20"–65" (range)
2. Diameter of main bag member 20: 28" Preferred (2"–50" range)
3. Thickness of main bag member 20: 0.0013" (0.0007"–0.010" range)
4. Material of main bag member 20: Polyethylene, Polypropylene, PVC, or other flexible film or fabric
5. Length of tubular leg members 30: 70" (Range 35"–100")

If leg is comprised of two sections: 38" (17"–50" range)

6. Diameter of leg members 30: 8" (5"–20" range)
7. Thickness of leg members 30: As #3 above
8. Material of leg members 30: As #4 above
9. Color of bag member 20 and of leg members 30: BLACK OR ANY OTHER DARK COLOR The above are only by way of example, and are not limiting.

Figure 11:
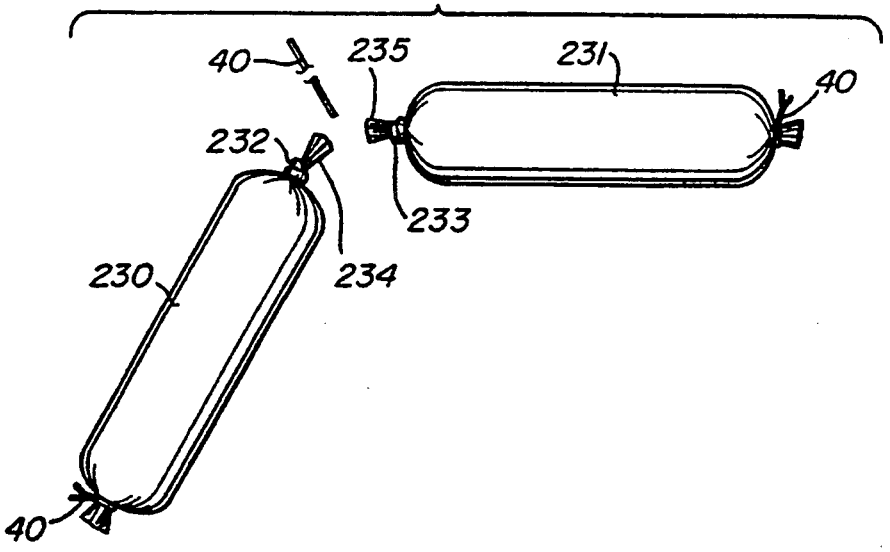
FIG. 11 is a perspective view of a modification of the leg structure of the spider-like decorative object of the present invention, shown in a disassembled state.

A modified "leg" structure for the spider-like decorative object of the present invention is shown in FIG. 11. In this modified embodiment, the leg structures each include two elongated tubular bags 230, 231, each of which are approximately half the length of the single unitary bag 30 shown in FIGS. 1 and 2. In use, each of the bags 230, 231 when empty, are tied in a knot 232, 233, respectively at one end, so as to leave a "tail" 234, 235, respectively, of bag material. The bags are filled with leaves, crumpled newspapers, or other suitable filling material, and are then tied off at their respective other ends of means of twist ties 40, as shown in FIG. 11. The free tails or extra bag material 234, 235 are then overlapped on one another, and "tied" together with a twist tie 40 which is representationally shown in FIG. 11. The result is an articulation point at the area where the two bags are tied together adjacent their respective knots 232, 233. The tying at the tails 234, 235 can be accomplished either before or after filling of the bags with filling material.

Also, in the embodiment of FIG. 11, instead of knotting the ends 232, 233 as shown, the ends 232, 233 can be tied off by means of respective twist ties 40, in the same manner as the remote ends in FIG. 11, prior to filling of the bags. Then, the two individual bags can be further tied together at the tied off ends, either by means of the "tie" which are already installed on the tied off ends or by means of a further additional tie 40, as described above with respect to the knotted ends 232, 233.

Figure 2:
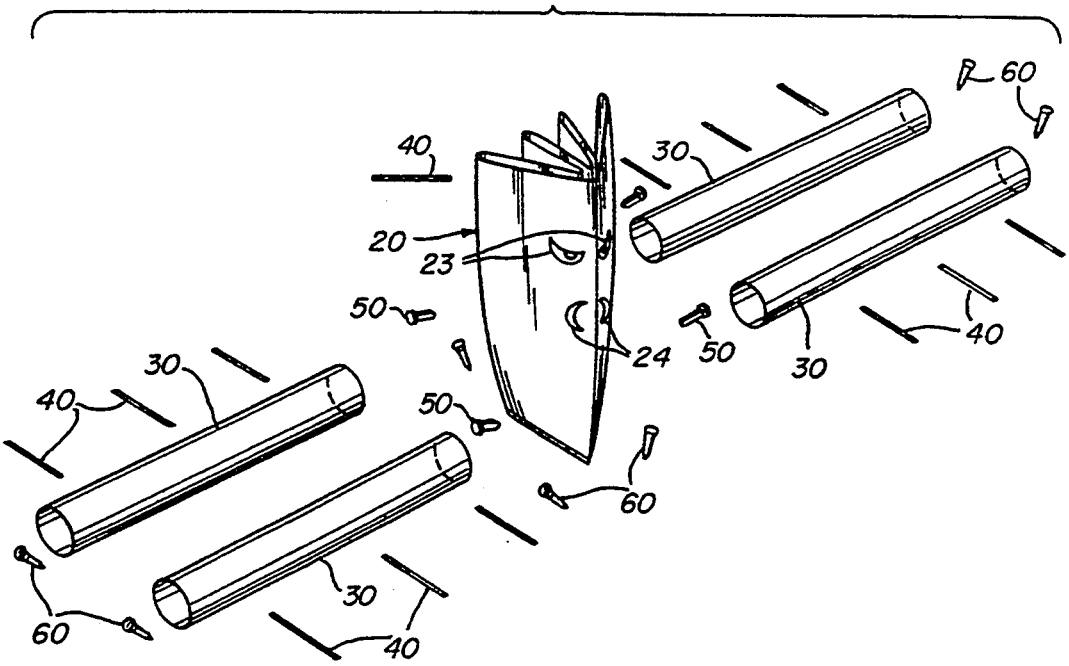
FIG. 2 is a perspective view of the parts of the spider-like decorative object of FIG. 1 in their unassembled, partially folded state.

The arrangement of FIG. 11 simplifies filling of the respective bag members 230, 231, since they are shorter than the elongated tubular members 30 of the previously described embodiment. Also, improved articulation of the connection point 234, 235 is achieved due to the additional bag material at the knotted ends 232, 233 (or tied off ends 232, 233). In a preferred embodiment, the elongated bags 30 of FIGS. 1 and 2 are preferably between about 75 and 80 inches long, whereas the bags 230, 231 of FIG. 11 are each approximately one-half as long. In all other respects, the embodiment of FIG. 11 operates and is constructed in a manner similar to that described above with respect to FIGS. 1–8.

Preferably, the spider-like decorative object of the present invention is sold in kit form. A kit for the spider-like decorative object comprises, for example, at least main bag member 20, a plurality of elongated tubular bag-like members 30, a plurality of twist ties, a plurality of pegs or other stakes, and a plurality of clips or tack members for connecting the leg members 30 to the main bag 20 during assembly. Either facial indicia may be previously imprinted on the main bag member, or facial indicia may be supplied as stick-on facial members which can be placed on the bag member, after filling, by the user.

In an alternative kit, a support device to replace the hanger 70 can be provided for supporting the articulated intermediate portion of the leg members 30. Still further, an alternate kit may comprise a pair of tubular members for each leg, which are connected together as described hereinabove with respect to FIG. 11. A suitable number of twist ties 40, pegs or stakes 60 and clips or tacks 50 are provided, depending upon the number of legs, the number of bags comprising each leg, and the like.

While there has been described and illustrated preferred embodiments of the present invention, it is apparent that numerous alterations, additions and omissions made be made without departing from the spirit and scope of the invention as defined in the claims.

What is claimed is:

1. A decorative object simulating the appearance of a fanciful conception of a spider, comprising:

a main bag member having a filling therein, said main bag member being made of flexible plastic material and simulating the appearance of a body portion of said decorative object; and a plurality of elongated tubular leg members each made of a flexible elongated tubular plastic bag and having a filling therein, said leg members simulating the appearance of legs of a fanciful conception of a spider, said leg members being arranged adjacent said main bag member, and arranged at spaced apart locations around the periphery of said main bag member to extend from said main bag member and simulate the appearance of a plurality of legs of a fanciful conception of a spider;

each leg member having an articulated portion at an intermediate portion of said leg member; and said articulated portion comprising a tied-off portion at said intermediate portion of said elongated tubular member.

2. The decorative object of claim 1, wherein said leg members are raised up, relative to a surface on which the decorative object is placed, in the vicinity of said articulated portion of said respective leg members.

3. The decorative object of claim 2, wherein said raised up leg members have the appearance of an inverted V-shape.

4. The decorative object of claim 1, wherein each of said leg members comprises a single elongated tubular bag, and said tied-off portion is at an intermediate portion of said single bag.

5. The decorative object of claim 1, wherein said leg members each comprise two filled elongated tubular bags, closed at opposite ends thereof, and connected together at respective closed end portions thereof, said connected together portions comprising said articulated portion.

6. The decorative object of claim 5, wherein closed end portions of said respective bags, which are connected together at said articulated portion, each comprise a knotted end portion of a respective tubular bag.

7. The decorative object of claim 1, further comprising means for raising up said articulated portion of each of said elongated tubular leg members, said raising-up means comprising an elongated member connected at said articulated portion and extending upward from the ground or a support surface on which said decorative object is placed.

8. The decorative object of claim 7, wherein said raising-up means comprises an elongated wire member.

9. The decorative object of claim 8, wherein said elongated wire member is pierced into the ground substantially below said articulated portion, and extends upwardly to said articulated portion for supporting said articulated portion at a raised-up position.

10. The decorative object of claim 1, comprising means for closing said main bag member after filling thereof; and means for closing opposite ends of the filled tubular leg members to prevent the filling from coming out thereof.

11. The decorative object of claim 7, wherein said respective leg members are connected to said main bag member at proximal free ends thereof and to the ground or the support surface at remote free ends thereof.

12. The decorative object of claim 1, wherein said respective leg members are connected to said main bag member at proximal free ends thereof and to the ground or a support surface at remote free ends thereof.

* * * * *